US008771208B2

(12) United States Patent
Agrawal et al.

(10) Patent No.: US 8,771,208 B2
(45) Date of Patent: Jul. 8, 2014

(54) POWERED ORTHOSIS SYSTEMS AND METHODS

(76) Inventors: Sunil K. Agrawal, Newark, DE (US); Kyle N. Winfree, Paoli, PA (US); Paul Stegall, Kansas City, MO (US); John P. Scholz, Newark, DE (US)

( * ) Notice: Subject to any disclaimer, the term of this patent is extended or adjusted under 35 U.S.C. 154(b) by 371 days.

(21) Appl. No.: 13/213,176

(22) Filed: Aug. 19, 2011

(65) Prior Publication Data

US 2012/0046578 A1 Feb. 23, 2012

Related U.S. Application Data

(60) Provisional application No. 61/375,171, filed on Aug. 19, 2010.

(51) Int. Cl.
*A61H 1/00* (2006.01)
*A61H 1/02* (2006.01)
*A61H 5/00* (2006.01)

(52) U.S. Cl.
USPC ..... 601/35; 601/33; 601/34; 601/5

(58) Field of Classification Search
USPC ..... 601/5, 23, 33, 34, 35; 602/16, 19, 602/23–26
See application file for complete search history.

(56) References Cited

U.S. PATENT DOCUMENTS

| | | | | |
|---|---|---|---|---|
| 2,210,269 | A | 8/1940 | Taylor | |
| 5,020,790 | A | 6/1991 | Beard | |
| 5,333,604 | A | 8/1994 | Green | |
| 5,476,441 | A | 12/1995 | Durfee | |
| 6,039,707 | A | 3/2000 | Crawford | |
| 6,213,554 | B1 | 4/2001 | Marcoux | |
| 6,666,796 | B1 | 12/2003 | MacCready | |
| 6,666,831 | B1 | 12/2003 | Edgerton et al. | |
| 6,821,233 | B1 * | 11/2004 | Colombo et al. | 482/54 |

(Continued)

FOREIGN PATENT DOCUMENTS

| | | |
|---|---|---|
| GB | 1406420 | 9/1975 |
| WO | WO-9409727 A2 | 5/1994 |
| WO | WO-0028927 A1 | 5/2000 |

OTHER PUBLICATIONS

Agrawal, Abhishek, "Design of Gravity Balancing Leg Orthosis Using Non-Zero Free Length Springs", Mechanism and Machine Theory, vol. 40 (2005), 693-709.

(Continued)

*Primary Examiner* — Justine Yu
*Assistant Examiner* — Kathrynn Reilly
(74) *Attorney, Agent, or Firm* — RatnerPrestia

(57) ABSTRACT

Powered orthosis systems and methods are disclosed. An orthosis system includes a frame, a trunk brace adapted to be secured to a user's trunk, a trunk joint coupling the trunk brace to the frame, an upper leg brace adapted to be secured to a user's upper leg, a hip joint coupling the upper leg brace to the trunk brace, a lower leg brace adapted to be secured to a user's lower leg, a knee joint coupling the lower leg brace to the upper leg brace, and a controller. The hip joint or knee joint includes an actuator operable to rotate the adjacent braces relative to each other. The controller is programmed to operate the actuator. An orthosis method includes securing a user to the orthosis system, enabling the user to walk while secured to the orthosis system, and actuating the hip or knee actuator to rotate the adjacent braces.

21 Claims, 7 Drawing Sheets

(56) References Cited

U.S. PATENT DOCUMENTS

| | | | | |
|---|---|---|---|---|
| 7,247,128 | B2 | 7/2007 | Oga | |
| 7,431,707 | B2 * | 10/2008 | Ikeuchi | 602/16 |
| 7,537,573 | B2 * | 5/2009 | Horst | 601/5 |
| 7,544,155 | B2 | 6/2009 | Agrawal | |
| 7,601,104 | B2 | 10/2009 | Agrawal | |
| 8,147,436 | B2 * | 4/2012 | Agrawal et al. | 602/16 |
| 2003/0023195 | A1 | 1/2003 | Rahman | |
| 2004/0049291 | A1 | 3/2004 | Deharde | |
| 2005/0043661 | A1 | 2/2005 | Nashner | |
| 2006/0211956 | A1 | 9/2006 | Sankai | |
| 2006/0241539 | A1 | 10/2006 | Agrawal | |
| 2006/0293617 | A1 | 12/2006 | Einav | |
| 2008/0249438 | A1 | 10/2008 | Agrawal | |
| 2008/0255488 | A1 * | 10/2008 | Agrawal et al. | 602/23 |

OTHER PUBLICATIONS

Agrawal, Sunil K., "Theory and Design of an Orthotic Device for Full or Partial Gravity-Balancing of a Human Leg During Motion", IEEE Transactions on Neural Systems and Rehabilitation Engineering, vol. 12, No. 2 (Jun. 2004), 157-165.

Agrawal, Sunil K., "Design of an Orthotic Device for Full or Partial Gravity-Balancing of a Human Upper Arm During Motion", Proceedings of the IEEE/RSJ International Conference on Intelligent Robots and Systems (Oct. 2003), 2841-2846.

Agrawal, Sunil K., "Design and Prototype of Gravity-Balanced Leg Orthosis", International Journal of HWRS, vol. 4, No. 3 (Sep. 2003), 13-16.

Agrawal, Abhishek, "Design of a Novel Two Degree-of-Freedom Ankle-Foot Orthosis", 8 pgs.

Aoyagi, D., "An Assistive Robotic Device that Can Synchronize to the Pelvic Motion During Human Gait Training", Proceedings of the 9th International Conference on Rehabilitation Robotics (Jun. 28-Jul. 1, 2005), 565-568.

Bajd, T., "Standing-Up of a Healthy Subject and a Paraplegic Patient", J. Biomechanics, vol. 15, No. 1 (1982), 1-10.

Banala, Sai K., "Robot Assisted Gait Training with Active Leg Exoskeleton (ALEX)", IEEE Transactions on Neural Systems and Rehabilitation Engineering, vol. 17, No. 1 (Feb. 2009), 2-8.

Banala, Sai K., "Gait Rehabilitation with an Active Leg Orthosis", Proceedings of IDETC/CIE 2005, ASME International Design Engineering Technical Conferences and Computers and Information in Engineering Conference (Sep. 24-28, 2005), 1-7.

Banala, Sai K., "Gravity Balancing Leg Orthosis and Its Performance Evaluation", 12 pgs.

Banala, Sai K., "A Gravity Balancing Leg Orthosis for Robotic Rehabilitation", Proceedings of the IEEE International Conference on Robotics & Automation (Apr. 2004), 2474-2479.

Banala, Sai K., "A Powered Leg Orthosis for Gait Rehabilitation of Motor-Impaired Patients", IEEE International Conference on Robotics and Automation (Apr. 10-14, 2007), 4140-4145.

Bernhardt, Michael, "Hybrid Force-Position Control Yields Cooperative Behaviour of the Rehabilitation Robot LOKOMAT", Proceedings of the IEEE 9th International Conference on Rehabilitation Robotics (Jun. 28-Jul. 1, 2005), 536-539.

Cai, Lance L., "Assist-as-Needed Training Paradigms for Robotic Rehabilitation of Spinal Cord Injuries", Proceedings of the IEEE International Conference on Robotics and Automation (May 2006), 3504-3511.

Donaldson, N., "FES Standing: Control by Handle Reactions of Leg Muscle Stimulation (CHRELMS)", IEEE Transactions on Rehabilitation Engineering, vol. 4, No. 4 (Dec. 1996), 280-284.

Ekkelenkamp, J., "LOPES: A Lower Extremity Powered Exoskeleton", IEEE International Conference on Robotics and Automation (Apr. 10-14, 2007), 3132-3133.

Fattah, Abbas, "On the Design of a Passive Orthosis to Gravity Balance Human Legs", Journal of Mechanical Design, vol. 127 (Jul. 2005), 802-808.

Fattah, Abbas, "Design of a Passive Gravity-Balanced Assistive Device for Sit-to Stand Tasks", Journal of Mechanical Design, vol. 128 (Sep. 2006), 1122-1129.

Fattah, Abbas, "Design of a Gravity-Balanced Assistive Device for Sit-to-Stand Tasks", Proceedings of DETC '04, ASME Design Engineering Technical Conferences (Sep. 28-Oct. 2, 2004, 1-7.

International Application Serial No. PCT/US2008/004319, International Preliminary Report Patentability mailed Oct. 6, 2009, 5 pgs.

International Application Serial No. PCT/US08/04319, International Search Report and Written Opinion mailed Jul. 25, 2008, 8 pgs.

International Application Serial No. PCT/US08/04330, International Search Report and Written Opinion mailed Jul. 25, 2008, 9 pgs.

Jezernik, Saso, "Automatic Gait-Pattern Adaptation Algorithms for Rehabilitation with a 4-DOF Robotic Orthosis", IEEE Transactions on Robotics and Automation, vol. 20, No. 3 (Jun. 2004), 574-582.

Kamnik, Roman, "Robot Assistive Device for Augmenting Standing-Up Capabilities in Impaired People", Proceedings of the IEEE/RSJ International Conference on Intelligent Robots and Systems (Oct. 2003), 3606-3611.

Kamnik, Roman, "Rehabilitation Robot Cell for Multimodal Standing-Up Motion Augmentation", Proceedings of IEEE International Conference on Robotics and Automation (Apr. 2005), 2277-2282.

Kim, Seok Hun, "Robot-Assisted Modifications of Gait in Healthy Individuals", Exp. Brain Res., vol. 202 (2010), 809-824.

Peshkin, Michael, "KineAssist: A Robotic Overground Gait and Balance Training Device", Proceedings of the IEEE 9th International Conference on Rehabilitation Robotics (Jun. 28-Jul. 1, 2005), 241-246.

Pledgie, Stephen, "Tremor Suppression Through Impedance Control", IEEE Transactions on Rehabilitation Engineering, vol. 8, No. 1 (Mar. 2000), 53-59.

Riener, Robert, "Patient-Cooperative Strategies for Robot-Aided Treadmill Training: First Experimental Results", IEEE Transactions on Neural Systems and Rehabilitation Engineering, vol. 13, No. 3 (Sep. 2005), 380-394.

Riener, Robert, "Patient-Driven Control of FES-Supported Standing Up and Sitting Down: Experimental Results", IEEE Transactions on Rehabilitation Engineering, vol. 8, No. 4 (Dec. 2000), 523-529.

Riener, Robert, "Identification of Passive Elastic Joint Moments in the Lower Extremities", Journal of Biomechanics, vol. 32 (1999), 539-544.

Riener, Robert, "Human-Centered Rehabilitation Robotics", Proceedings of the 9th International Conference on Rehabilitation Robotics (Jun. 28-Jul. 1, 2005), 319-322.

International Search Report dated Mar. 27, 2012, application No. PCT/US2011/048376.

* cited by examiner

POWERED ORTHOSIS SYSTEMS AND METHODS

STATEMENT REGARDING FEDERALLY SPONSORED RESEARCH

The subject matter of the present invention was funded at least in part under National Institutes of Health Grant No. HD38582. The U.S. Government may have certain rights in this invention.

CROSS REFERENCE TO RELATED APPLICATIONS

This application claims priority to U.S. Patent Application No. 61/375,171, entitled "ACTIVE LEG EXOSKELETON," filed on Aug. 19, 2010, the contents of which are incorporated herein by reference in their entirety.

FIELD OF THE INVENTION

The present invention relates generally to orthosis systems and methods, and more particularly, to powered orthosis systems and methods for use in assisting walking.

BACKGROUND OF THE INVENTION

Often, patients with significant one-time or permanent illnesses that affect the neurological system (e.g. stroke, traumatic spinal cord injury, cerebral palsy, spina bifida) will experience degradation in their control of motor skills. In particular, this degradation in control can significantly affect a patient's walking ability. Thus, patients may require physical therapy following a neurological illness to regain walking ability.

A number of orthosis (or orthotic) systems have been developed to assist patients in recovering their ability to walk. One such orthosis system is disclosed in U.S. patent application Ser. No. 12/062,903, entitled "POWERED ORTHOSIS," filed on Apr. 4, 2008, the contents of which are incorporated herein by reference in their entirety. These systems operate by retraining the coordination among the joints within and across a user's impaired limbs during a walking motion. By repetitively practicing with an orthosis system, the user may redevelop their motor skills and recover walking ability. However, time spent during this rehabilitation process may be frustrating or painful for the patient. Accordingly, orthosis systems that improve recovery time and patient comfort are desired.

SUMMARY OF THE INVENTION

Aspects of the present invention relate to powered orthosis systems and methods.

In accordance with one aspect of the present invention, an orthosis system includes a frame for supporting the orthosis system, a trunk brace adapted to be secured to a trunk of a user, at least one trunk joint coupling the trunk brace to the frame, an upper leg brace adapted to be secured to an upper leg of the user, at least one hip joint coupling the upper leg brace to the trunk brace, a lower leg brace adapted to be secured to a lower leg of the user, at least one knee joint coupling the lower leg brace to the upper leg brace, and a controller. The at least one hip joint includes a hip actuator operable to rotate the upper leg brace relative to the trunk brace. The controller is programmed to operate the hip actuator to rotate the upper leg brace relative to the trunk brace.

In accordance with another aspect of the present invention, an orthosis system includes a frame for supporting the orthosis system, a trunk brace adapted to be secured to a trunk of a user, at least one trunk joint coupling the trunk brace to the frame, an upper leg brace adapted to be secured to an upper leg of the user, at least one hip joint coupling the upper leg brace to the trunk brace, a lower leg brace adapted to be secured to a lower leg of the user, at least one knee joint coupling the lower leg brace to the upper leg brace, and a controller. The at least one knee joint includes a knee actuator operable to rotate the lower leg brace relative to the upper leg brace. The controller is programmed to operate the knee actuator to rotate the lower leg brace relative to the upper leg brace.

In accordance with yet another aspect of the present invention, an orthosis method includes securing a user to an orthosis system having a trunk brace, an upper leg brace, and a lower leg brace, enabling the user to walk while secured to the orthosis system, and actuating at least one of (i) a hip actuator to rotate the upper leg brace relative to the trunk brace and (ii) a knee actuator to rotate the lower leg brace relative to the upper leg brace.

BRIEF DESCRIPTION OF THE DRAWINGS

The invention is best understood from the following detailed description when read in connection with the accompanying drawings, with like elements having the same reference numerals. When a plurality of similar elements are present, a single reference numeral may be assigned to the plurality of similar elements with a small letter designation referring to specific elements. When referring to the elements collectively or to a non-specific one or more of the elements, the small letter designation may be dropped. This emphasizes that according to common practice, the various features of the drawings are not drawn to scale unless otherwise indicated. On the contrary, the dimensions of the various features may be expanded or reduced for clarity. Included in the drawings are the following figures.

DETAILED DESCRIPTION OF THE INVENTION

Figure 1A:
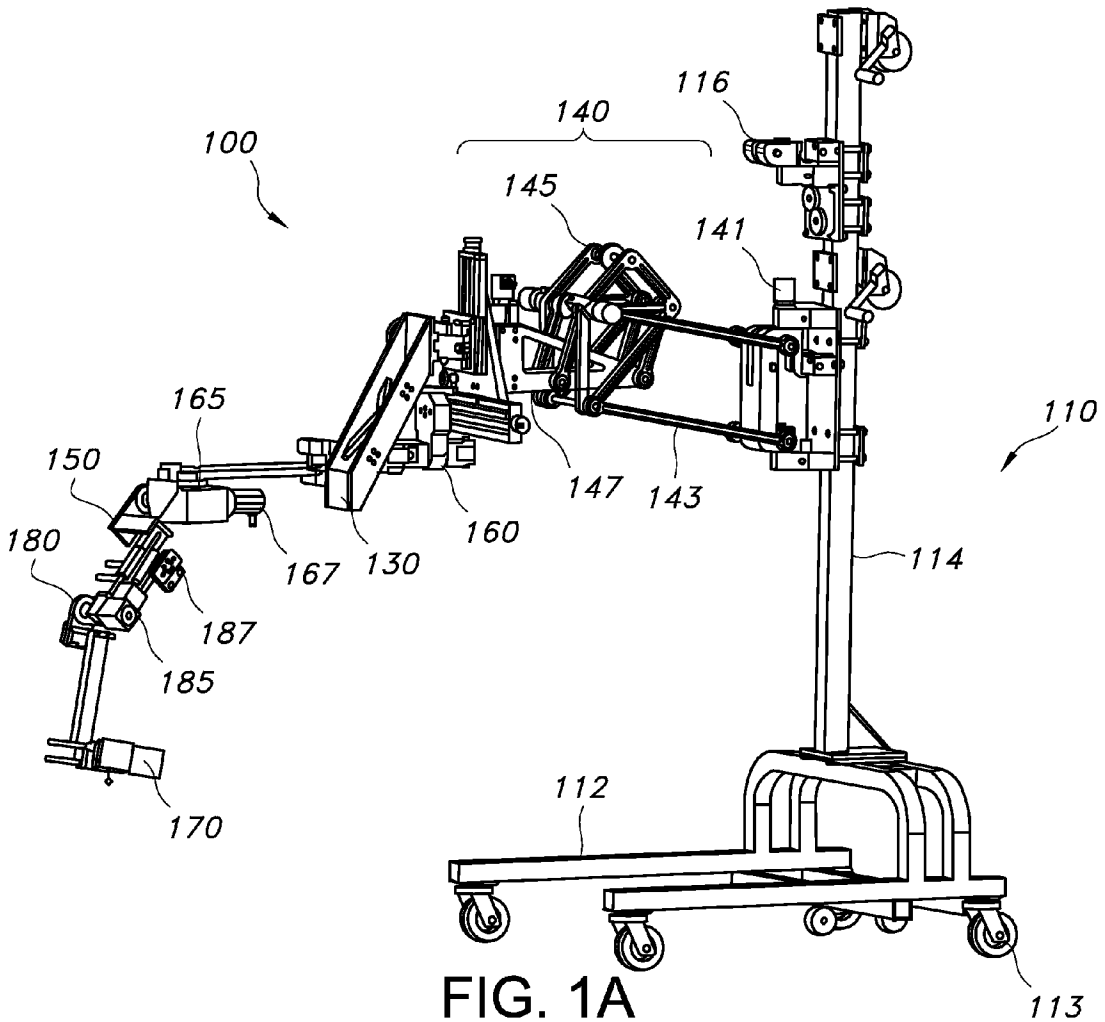
FIG. 1A is a diagram of an exemplary orthosis system in accordance with aspects of the present invention.

The orthosis systems and methods disclosed herein are usable to assist a user in developing or regaining the ability to walk. Generally, these systems and methods generate forces for assisting the user in moving the appropriate limbs in a walking motion along a desired movement path at a desired speed (trajectory). At least a portion of the movement is performed under the user's own power. The systems and methods may be used by users who are performing walking motions on a treadmill.

The various aspects of the present invention relate generally to powered orthosis systems adapted to be secured to a corresponding body portion of a user for guiding the motion of the user. The orthosis system has a plurality of structural members and one or more joints adjoining adjacent structural members. One or more springs may be connected to the structural members in order to provide gravity balancing of the orthosis system independent of configuration. The joints have one or more degrees of freedom and a range of joint angles. One or more of the joints has at least one back-drivable actuator governed by at least one joint actuator controller for controlling the joint angle. The one or more joint actuator controllers may be synchronized to cause the corresponding joint actuators to generate forces for assisting the user to move the orthosis system at least in part under the user's power along a desired trajectory within an allowed tolerance.

The systems and methods disclosed herein are particularly suitable for users that are developing or redeveloping control of motor skills due to neurological disorders including, for example, stroke, traumatic spinal cord injury, cerebral palsy, or spina bifida. These systems and methods may be effective for both adults and children.

Referring now to the drawings, FIGS. 1A-3 illustrate an exemplary orthosis system 100 in accordance with aspects of the present invention. Orthosis system 100 may be usable to assist a user in developing or regaining the ability to walk. As a general overview, orthosis system 100 includes a frame 110, a trunk brace 130, an upper leg brace 150, a lower leg brace 170, and a controller 190. Additional details of orthosis system 100 are described herein.

As used herein, the term "brace" is intended to encompass any and all structures adapted to be secured or coupled to a portion of the user of the orthosis system. For example, and without limitation, the braces of the present invention may include and/or refer to straps, buckles, fasteners, or any other structure adapted for attachment to the user. The braces may, but need not, include structures adapted to support, align, or otherwise hold part of the user in a certain position or angle. Suitable structures for use as braces of the present invention will be understood to one of ordinary skill in the art from the description herein.

Frame 110 supports orthosis system 100. Frame 110 includes a base 112 and a stand 114, as shown in FIG. 1A. Base 112 is placed on a walking surface. Base 112 is shaped to allow room for a user of orthosis system 100 to perform a walking motion. In an exemplary embodiment, base 112 is shaped to accommodate a treadmill (not shown) on which the user performs the walking motion. Base 112 of frame 110 may include wheels 113 to enable movement of orthosis system 100. Stand 114 extends in an upright direction from base 112. Stand 114 includes a plurality of areas to which components of orthosis system 100 may be mounted, as will be described in greater detail below. Frame 110 may be fashioned from any suitable rigid material using conventional manufacturing processes.

Figure 1B:
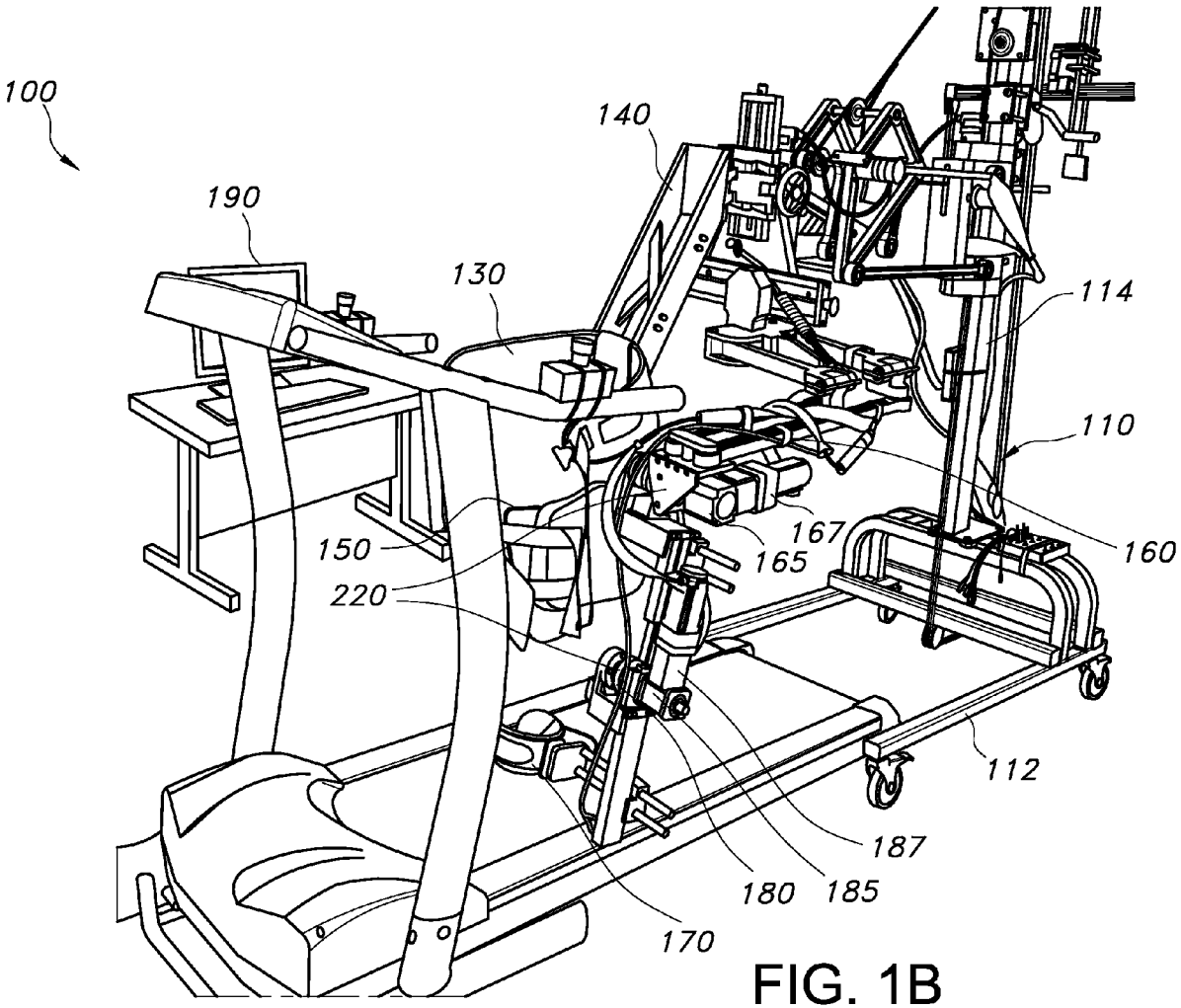
FIG. 1B is an image of the orthosis system of FIG. 1A.

Trunk brace 130 is adapted to be secured to the trunk of a user. Trunk brace 130 anchors the user of orthosis system 100 to frame 110. In an exemplary embodiment, trunk brace 130 comprises a padded belt adapted to be secured around the trunk of the user, as shown in FIG. 1B. Trunk brace 130 may be secured in place using suitable fasteners such as, for example, a buckles or straps. Suitable trunk braces 130 for use in the present invention will be understood by one of ordinary skill in the art from the description herein.

Trunk brace 130 is coupled to frame 110 with a trunk joint 140, as shown in FIGS. 1A and 1B. Thus, trunk joint 140 connects trunk brace 130 (and the user secured thereto) to frame 110. Trunk joint 140 enables movement by the user in multiple degrees of freedom relative to frame 110, as set forth below.

Figure 2:
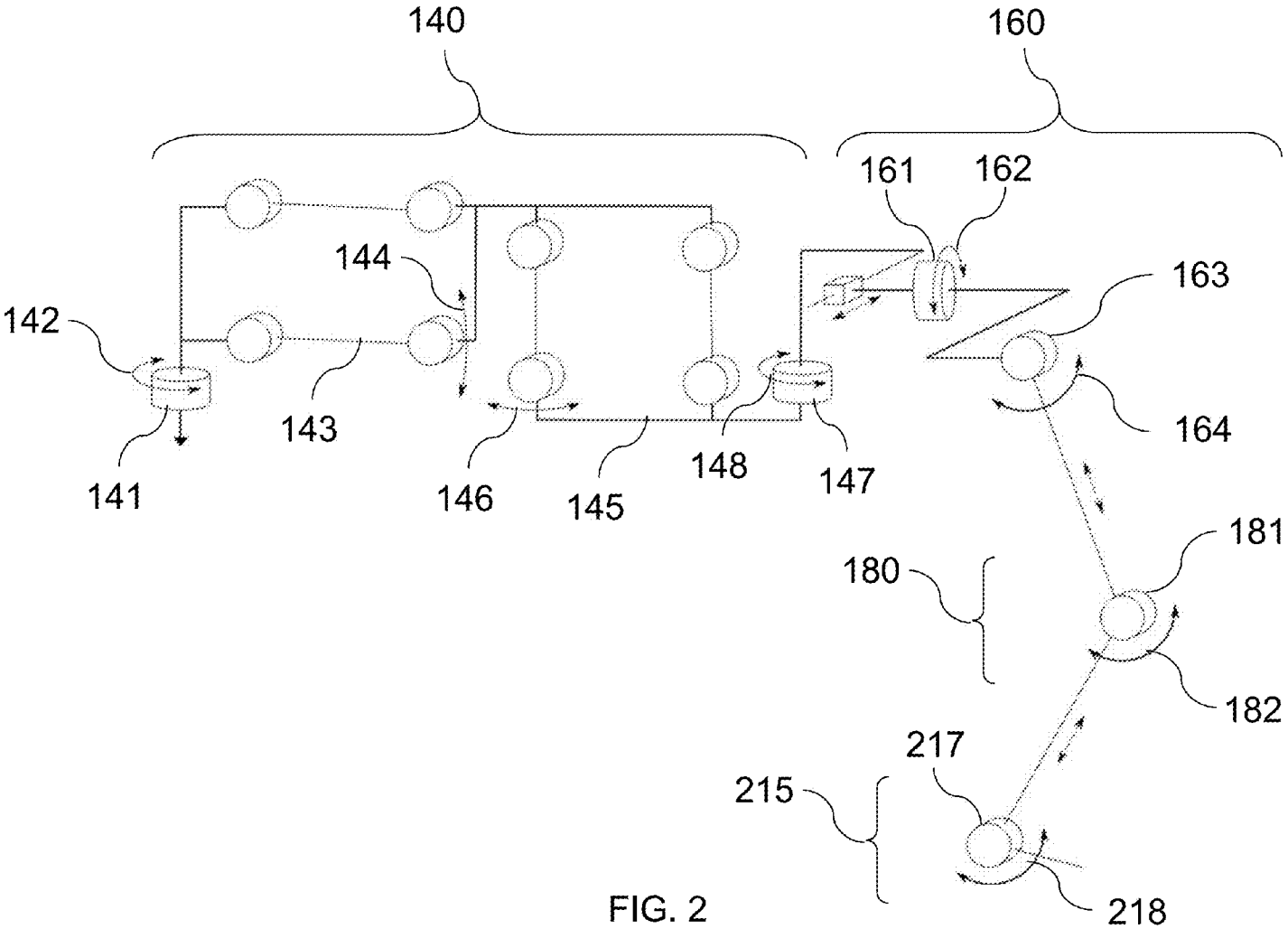
FIG. 2 is a diagram illustrating the degrees of freedom of the orthosis system of FIG. 1A.
Figure 3:
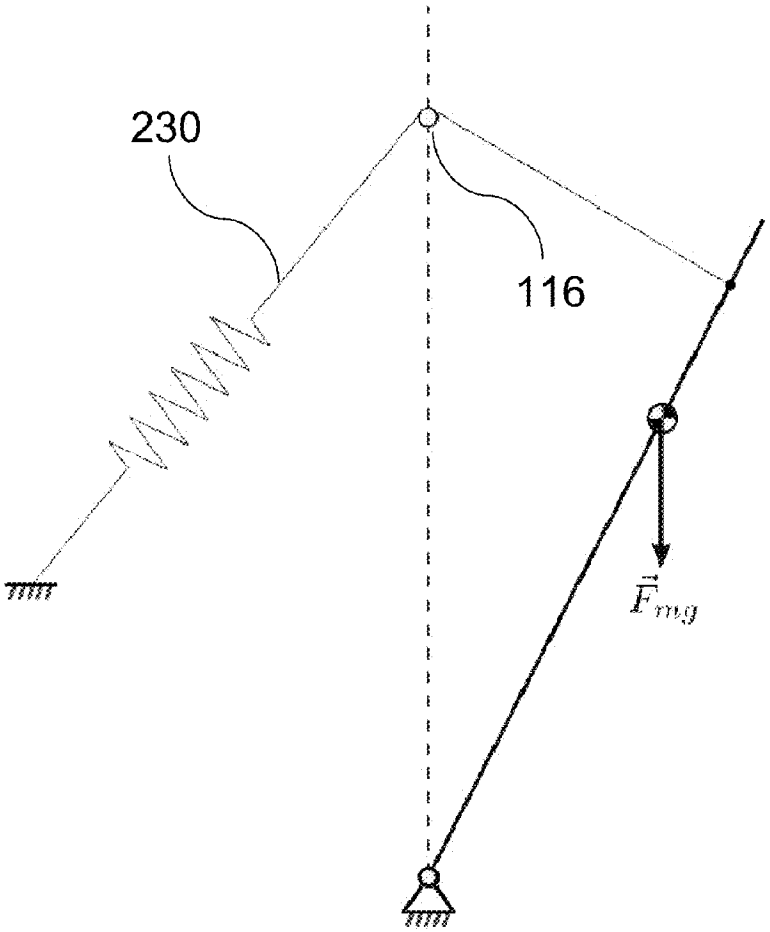
FIG. 3 is a diagram illustrating a gravity balancing spring of the orthosis system of FIG. 1A.

In an exemplary embodiment, trunk joint 140 enables the trunk of the user to move in four uncoupled degrees of freedom, as shown in FIG. 2. As used herein, a degree of freedom is uncoupled if the user's movement in that degree of freedom does not require or compel movement in one of the other degrees of freedom. The four degrees of freedom comprise up/down motion, forward/backward motion, side-to-side motion, and rotation around a vertical axis. In this embodiment, trunk joint 140 includes: first and second rotational components 141 and 147 that enable side-to-side motion of the user relative to frame 110 (as shown by arrow 142 in FIG. 2) and rotation of the user around a vertical axis spaced from frame 110 (as shown by arrow 148 in FIG. 2); and first and second parallelogram linkage components 143 and 145 that enable up/down motion and forward/backward motion of the user relative to frame 110 (as shown by arrows 144 and 146 in FIG. 2). It is desirable that trunk joint 140 enable movement in these four uncoupled degrees of freedom in order to enable a user to perform the natural trunk movements that occur during a walking motion.

Upper leg brace 150 is adapted to be secured to the upper leg of a user. In an exemplary embodiment, upper leg brace 150 comprises one or more cuffs coupled to an elongated rigid structure (e.g., a rod). Desirably, upper leg brace 150 is adjustable in length and circumferential size to accommodate users having varying leg lengths and diameters. Suitable upper leg braces 150 for use in the present invention will be understood by one of ordinary skill in the art from the description herein.

Upper leg brace 150 is coupled to trunk brace 130 with a hip joint 160, as shown in FIG. 1A. Like trunk joint 140, hip joint 160 enables movement of upper leg brace 150 by the user in multiple degrees of freedom relative to trunk brace 130.

In an exemplary embodiment, hip joint 160 enables the upper leg brace 150 of the user to move in three uncoupled degrees of freedom relative to trunk brace 130, as shown in FIG. 2. The three degrees of freedom comprise flexion/extension rotation, abduction/adduction rotation, and rotation around a vertical axis. In this embodiment, hip joint 160 includes: a first rotational component 161 (e.g., a revolute joint) that enables abduction/adduction of the upper leg brace 150 relative to trunk brace 130 (as shown by arrow 162 in FIG. 2); a second rotational component 163 that enables flexion/extension of the upper leg brace 150 relative to trunk brace 130 (as shown by arrow 164 in FIG. 2); and a third rotational component (not shown) that enables rotation of the upper leg brace 150 around a vertical axis relative to the trunk brace 130. It is desirable that hip joint 160 enable movement in these three uncoupled degrees of freedom in order to enable a user to perform the normal movements that may occur during a walking motion.

Hip joint 160 may include at least one hip actuator 165. As set forth in greater detail below regarding the operation of orthosis system 100, hip actuator 165 is operable to rotate upper leg brace 150 relative to trunk brace 130. Hip actuator 165 may be operable to perform this rotation in one or more of the degrees of freedom of hip joint 160.

In an exemplary embodiment, hip actuator 165 includes a motor 167 that is coupled directly to hip joint 160 in order to perform the rotation. Motor 167 provides torque directly to hip joint 160 when instructed to do so by controller 190. Desirably, there is a one-to-one ratio between the torque required to move hip joint 160 and the torque delivered by motor 167. Suitable motors 167 for use with hip actuator 165 include, for example, AKM-22c motors provided by Kollmorgen. Other suitable motors for use with hip actuator 165 will be known to one of ordinary skill in the art from the description herein.

Lower leg brace 170 is adapted to be secured to the lower leg of a user. In an exemplary embodiment, lower leg brace 170 comprises components similar to those set forth above in the description of upper leg brace 150. Like upper leg brace 150, lower leg brace 170 is desirably adjustable in length and circumferential size to accommodate users having varying leg lengths and diameters. Suitable lower leg braces 170 for use in the present invention will be understood by one of ordinary skill in the art from the description herein.

Lower leg brace 170 is coupled to upper leg brace 150 with a knee joint 180, as shown in FIG. 1A. Knee joint 180 enables movement of lower leg brace 170 by the user in one degree of freedom relative to upper leg brace 150. In an exemplary embodiment, knee joint 180 includes a rotational component 181 that enables flexion/extension of the lower leg brace 170 relative to upper leg brace 150 (as shown by arrow 182 in FIG. 2).

Knee joint 180 may include at least one knee actuator 185. As set forth in greater detail below regarding the operation of orthosis system 100, knee actuator 185 is operable to rotate lower leg brace 170 relative to upper leg brace 150. In an exemplary embodiment, knee actuator 185 includes a motor 187 that is coupled directly to knee joint 180 in order to perform the rotation, as similarly described above with respect to motor 167 of hip actuator 165. Suitable motors 187 for use with knee actuator 185 include any of the motors set forth above with respect to motor 167.

Controller 190 controls the operation of orthosis system 100. When orthosis system 100 includes a hip actuator 165, controller 190 is programmed to operate hip actuator 165 to rotate upper leg brace 150 relative to trunk brace 130. When orthosis system 100 includes a knee actuator 185, controller 190 is programmed to operate knee actuator 185 to rotate lower leg brace 170 relative to upper leg brace 150. Further functionality of controller 190 is set forth in greater detail below regarding the operation of orthosis system 100. In an exemplary embodiment, controller 190 comprises a data processor. Suitable data processors for use as controller 190 will be known to one of ordinary skill in the art from the description herein. Controller 190 may further include data storage for storing data for use in controlling the operation of orthosis system 100, or data obtained during the operation of orthosis system 100. Controller 190 may be connected to the joints and/or actuators of orthosis system 100 by conventional wired or wireless transmission devices.

Orthosis system 100 is not limited to the above components, but may include alternative or additional components, as would be understood by one of ordinary skill in the art.

Figure 1C:
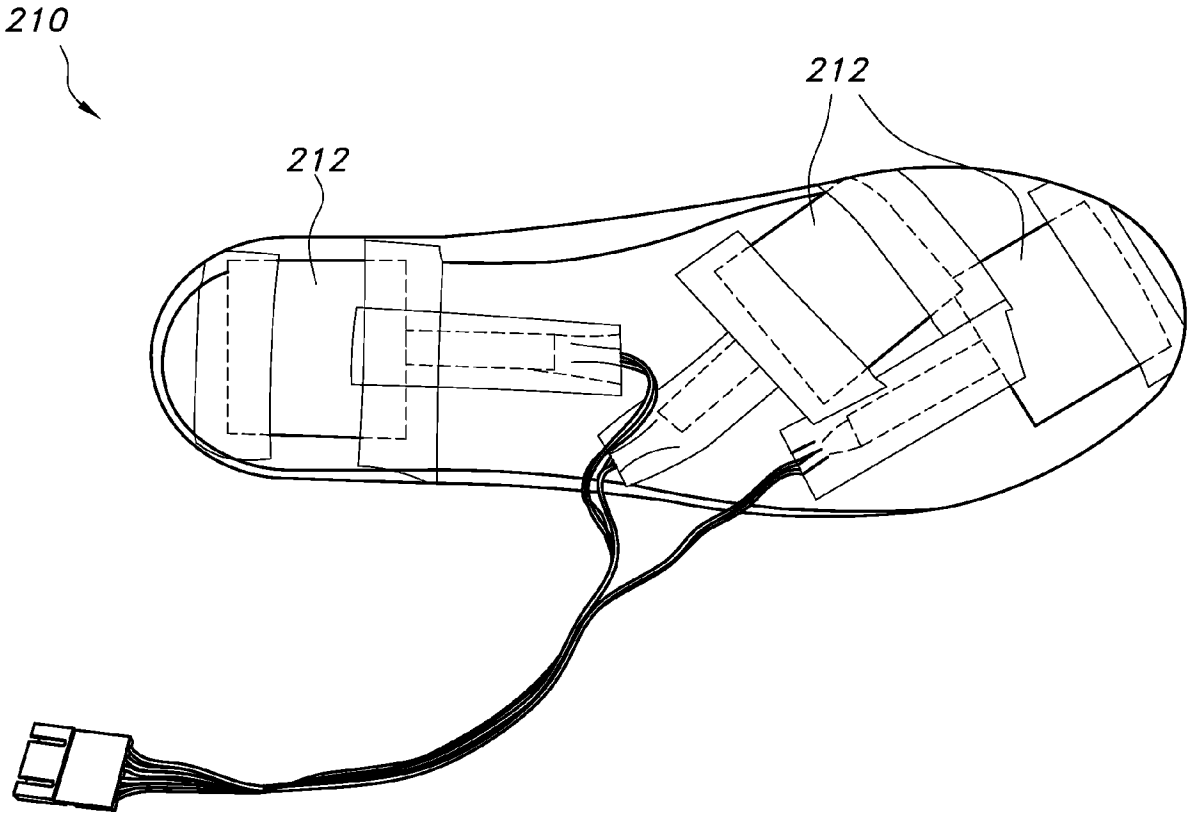
FIG. 1C is an image of a foot brace of the orthosis system of FIG. 1A.

For one example, orthosis system 100 may include a foot brace 210 adapted to be secured to the foot of a user, as shown in FIG. 1C. Foot brace 210 may be positioned, for example, with a foot-bed inserted within the shoe of the user of orthosis system 100. In an exemplary embodiment, foot brace 210 includes at least one pressure sensor 212. The pressure sensor may sense a pressure exerted on the foot brace by the user during the performance of a walking motion. The sensed pressure may then be transmitted to controller 190 for storage and/or analysis. Pressure sensors may be positioned on foot brace 210 such that they sense pressures at the heel, ball, and toes of the user's foot, as shown in FIG. 1C. Suitable pressure sensors for use with foot brace 210 include, for example, FlexiForce sensors provided by Tekscan, Inc.

Foot brace 210 may be coupled to lower leg brace 170 with an ankle joint 215. Ankle joint 215 enables movement of foot brace 210 by the user in one degree of freedom relative to lower leg brace 170. In an exemplary embodiment, ankle joint 215 includes a rotational component 217 that enables flexion/extension of the foot brace 210 relative to lower leg brace 170 (as shown by arrow 218 in FIG. 2).

For another example, orthosis system 100 may include at least one motion sensing device 220. Motion sensing devices 220 are positioned to record the motion of the user at the degrees of freedom of orthosis system 100. Motion sensing devices 220 may be positioned, for example, at hip joint 160 and/or at knee joint 180. Motion sensing devices 220 are configured to sense a motion of the hip or knee joint during use of orthosis system 100 by the user. The sensed motion may then be transmitted to controller 190 for storage and/or analysis. Motion sensing devices 220 include, for example, force sensors or torque sensors. In particular, motion sensing devices 220 may comprise encoders for sensing brace positioning and torque sensors for measuring user intent and providing feedback to controller 190. Suitable encoders for use as motion sensing devices 220 include, for example, Kubler encoders from Turck, Inc., or encoders provided with the above-described motors. Suitable torque sensors for use as motion sensing devices 220 include, for example, the Mini45 torque sensor from ATI Industrial Automation, Inc., or TRS series torque sensors from Transducer Techniques, Inc.

Figure 1D:
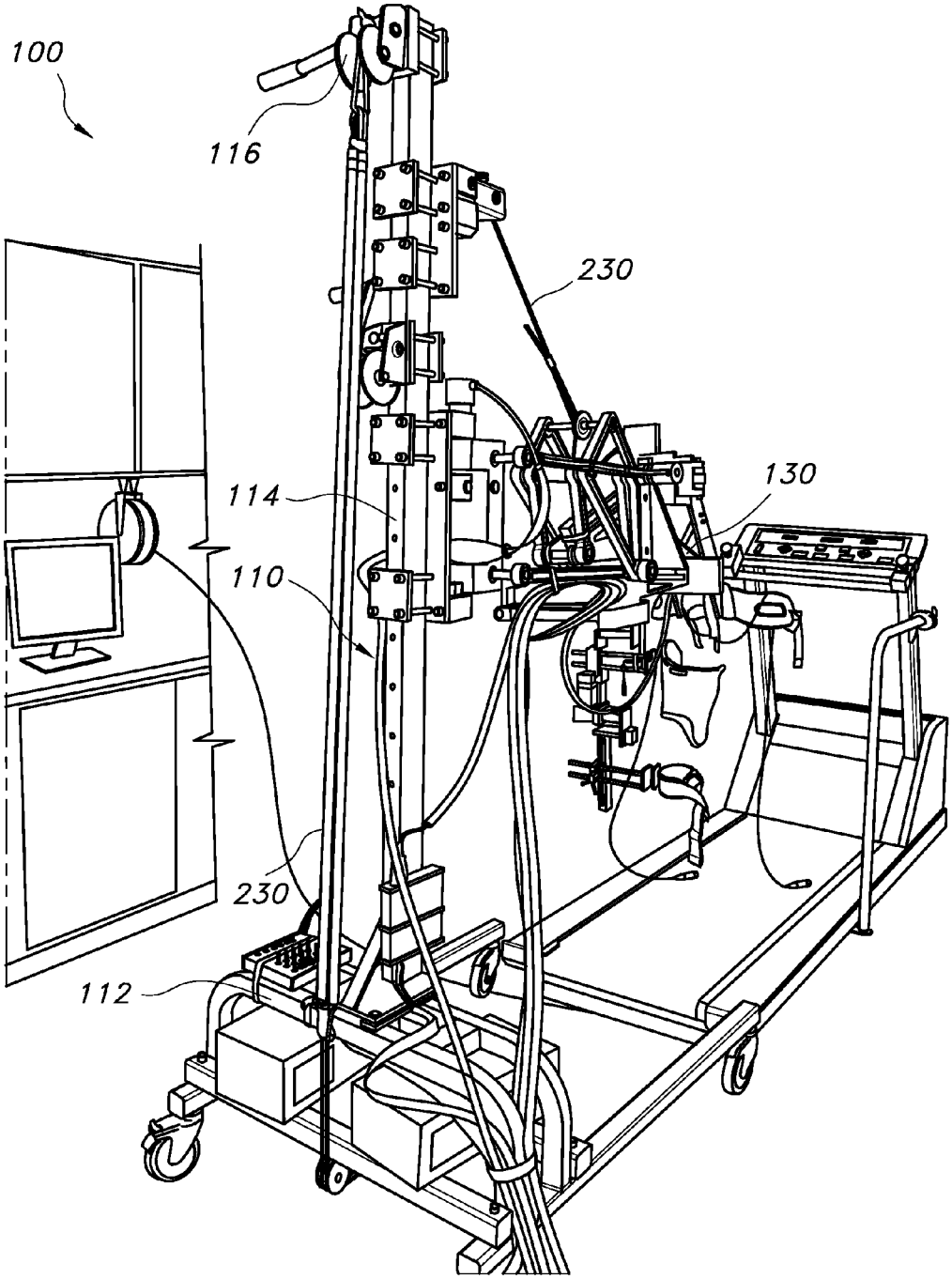
FIG. 1D is an image of a spring and pulley connection of the orthosis system of FIG. 1A.

For yet another example, orthosis system 100 may include at least one spring 230 coupled between trunk brace 130 and frame 110. Spring 230 is configured to remove at least a portion of the weight of orthosis system 100 from the user. In an exemplary embodiment, spring 230 is coupled between a rear surface of trunk brace 130 and an upper portion of stand 114 of frame 110, as shown in FIG. 1D. Frame 110 may include one or more pulleys 116 affixed to the upper portion of stand 114. Pulleys 116 are configured to couple the tension from spring 230 downward along stand 114 toward a fixed attachment at base 112 of frame 110. Accordingly, at least a portion of the weight of trunk brace 130 and trunk joint 140 is lifted upward due to the elasticity of spring 230. The force of the spring 230 on the trunk brace 130 is diagrammatically shown in FIG. 3. Employing a spring 230 to provide an upward force may be desirable in order to enhance the comfort of the user of orthosis system 100. Additionally, this may be desirable in order to assist the user in performing a normal walking motion, i.e. by balancing the force of gravity and removing the weight of orthosis system 100 from the user.

While orthosis system 100 is described herein with respect to a single leg of the user, it will be understood that the invention is not so limited. Orthosis system 100 may include components identical to those described above in order to be secured to both legs of a user. Alternatively, orthosis system 100 may be configured to be usable on either the right or left leg of the user. Switching orthosis system 100 from one leg to another may be performed, for example, by rotating a portion of hip joint 160 to change the abduction/adduction degree of freedom to function properly with the chosen leg.

The operation of orthosis system 100 will now be described in accordance with aspects of the present invention. As set forth above, one or both of hip joint 160 and knee joint 180 may include a respective actuator that is operable to rotate the braces on either side of the joint relative to each other. For the purposes of illustration, the operation of orthosis system 100 will be described with respect to hip joint 160. However, it will be understood by one of ordinary skill in the art that substantially the same operations may be performed by knee joint 180 in addition to or in the alternative to hip joint 160.

As set forth above, controller 190 is programmed to selectively power motor 167 of hip actuator 165 in order to rotate upper leg brace 150 relative to trunk brace 130. In particular, controller 190 powers motor 167 in accordance with predetermined walking models.

Controller 190 may store in its data storage one or more predetermined walking models. The models correspond to the normal, healthy walking motion of a user of orthosis system 100. Each model is generated by storing data corresponding to the motion of hip joint 160 (e.g., the movement of hip joint 160 or the angle of upper leg brace 150 relative to trunk brace 130) along each degree of freedom during a normal, healthy walking motion. The models stored by controller 190 may be created, for example, by monitoring the movement of a healthy user of orthosis system 100 using motion sensing devices 220.

Once controller 190 has stored one or more predetermined walking models, controller 190 actuates hip actuator 165 in accordance with the stored models. For one example, controller 190 may actuate hip actuator 165 to perform the same movements as those stored in the normal, healthy walking model. Actuating the hip actuator 165 as described in this example may be desirable in order to enable a user of orthosis system 100 to experience the feeling of a normal, healthy walking motion in his or her limb(s).

For another example, controller 190 may only actuate hip actuator 165 when movement of hip joint 160 by the user differs from the normal, healthy walking model by a predetermined range. In this example, orthosis system 100 allows a user to perform a walking motion to the best of his or her ability. When the user's walking motion falls outside of a predetermined range from the normal, healthy walking model stored by controller 190, controller 190 actuates hip actuator 165 in order to correct the user's movements. Controller 190 may actuate hip actuator 165 in order to assist a desired walking motion of the user (i.e. to rotate the joint in the direction of the movement by the user), or may do so to resist an undesired walking motion of the user (i.e. to rotate the joint in the direction opposite from the movement by the user).

By allowing a user of orthosis system 100 to perform a walking motion on their own, and actuating hip actuator 165 only when this motion falls outside of a predetermined range, orthosis system 100 may improve the recovery time and performance of users in developing or regaining the ability to walk.

Figure 4:
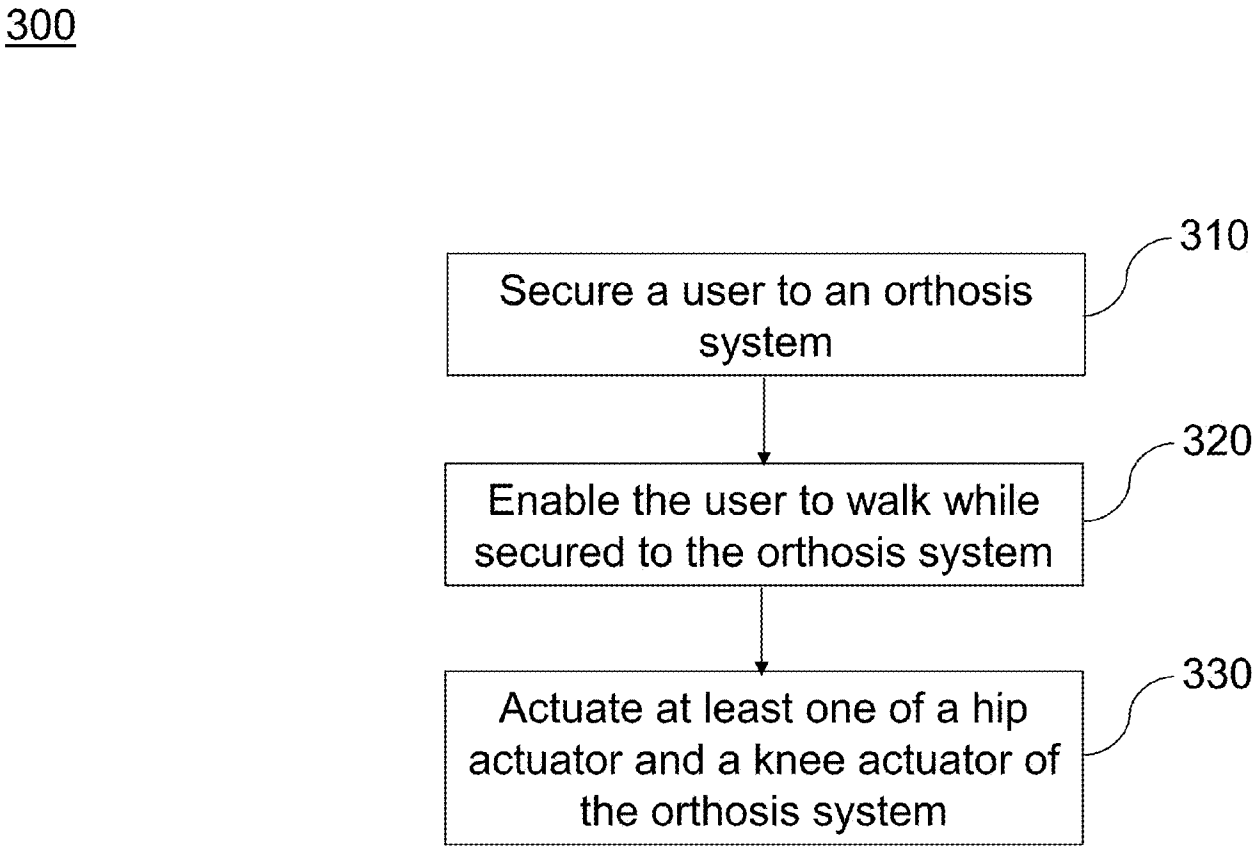
FIG. 4 is a flowchart of an exemplary orthosis method in accordance with aspects of the present invention.

FIG. 4 shows an exemplary orthosis method 300 in accordance with aspects of the present invention. Method 300 may be implemented to assist a user in developing or regaining the ability to walk. As a general overview, method 300 includes securing a user to an orthosis system, enabling the user to walk, and actuating at least one of a hip actuator and a knee actuator. Additional details of method 300 are described herein with respect to the components of orthosis system 100.

In step 310, a user is secured to an orthosis system. In an exemplary embodiment, the user is secured to orthosis system 100. Trunk brace 130 is secured to the trunk of a user; upper leg brace 150 is secured to the upper leg of the user; and lower leg brace 170 is secured to the lower leg of a user. The length of upper leg brace 150 and lower leg brace 170 may be adjusted to correspond to the length of the user's leg. When orthosis system 100 includes a foot brace 210, the foot brace may be secured to the foot of the user, e.g., by insertion into the user's shoe.

In step 320, the user is enabled to walk. In an exemplary embodiment, the user walks while secured to orthosis system 100. As set forth above, the user may desirably be positioned on a treadmill to enable the user to perform a walking motion without requiring movement of orthosis system 100.

In step 330, at least one of a hip actuator and a knee actuator is actuated. In an exemplary embodiment, orthosis system 100 may include a hip actuator 165 and/or a knee actuator 185. As the user performs a walking motion while secured to orthosis system 100, controller 190 actuates (i) hip actuator 165 to rotate upper leg brace 150 relative to trunk brace 130, and/or (ii) knee actuator 185 to rotate lower leg brace 170 relative to upper leg brace 150.

Step 330 may be performed in accordance with stored walking models, as described above with respect to the operation of orthosis system 100. For one example, controller 190 may actuate the hip and/or knee actuator to perform the same movements as those stored in the normal, healthy walking model. For another example, controller 190 may only actuate the hip and/or knee actuator when motion of the corresponding joint differs from the normal, healthy walking model by a predetermined range. Step 330 may be performed in order to assist a desired walking motion of the user, or may be performed in order to resist an undesired walking motion of the user.

Method 300 is not limited to the above steps, but may include alternative steps and additional steps, as would be understood by one of ordinary skill in the art from the description herein.

For one example, it may be desirable to record the use of the orthosis system in order to monitor and assist in the progress of the user in developing or regaining the ability to walk. Similarly, it may be desirable to record the use of the orthosis system by a healthy user in order to store and generate normal, healthy walking models. Accordingly, method 300 may further include the step of recording a walking motion of the user while the user is secured to the orthosis system. In an exemplary embodiment, controller 190 records the motion of the user of orthosis system 100 using motion sensing devices 220.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. An orthosis system comprising:

a frame for supporting the orthosis system;

a trunk brace adapted to be secured to a trunk of a user;

at least one trunk joint coupling the trunk brace to the frame, at least one trunk joint enabling the trunk of the user to move relative to the frame in four degrees of freedom, wherein movement in each of the four degrees of freedom is uncoupled from movement in any of the other degrees of freedom;

an upper leg brace adapted to be secured to an upper leg of the user;

at least one hip joint coupling the upper leg brace to the trunk brace, the at least one hip joint including a hip actuator operable to rotate the upper leg brace relative to the trunk brace;

a lower leg brace adapted to be secured to a lower leg of the user;

at least one knee joint coupling the lower leg brace to the upper leg brace; and a controller programmed to operate the hip actuator to rotate the upper leg brace relative to the trunk brace.

2. The orthosis system of claim 1, wherein the controller is programmed to operate the hip actuator when a motion of the hip joint falls outside of a predetermined range.

3. The orthosis system of claim 2, wherein the controller operates the hip actuator to assist a walking motion of the user.

4. The orthosis system of claim 2, wherein the controller operates the hip actuator to resist a walking motion of the user.

5. The orthosis system of claim 1, wherein the hip actuator comprises a motor coupled directly to the hip joint to rotate the upper leg brace relative to the trunk brace.

6. The orthosis system of claim 1, wherein the four uncoupled degrees of freedom comprise up/down motion, forward/backward motion, side-to-side motion, and rotation around a vertical axis.

7. The orthosis system of claim 1, wherein the upper leg brace and the lower leg brace are adjustable in length.

8. The orthosis system of claim 1, further comprising:

a foot brace adapted to be secured to a foot of the user, the at least one foot brace comprising a pressure sensor to sense a pressure exerted on the foot brace by the user.

9. The orthosis system of claim 1, further comprising:

at least one motion sensing device positioned at the hip joint, the at least one sensing device configured to sense a motion of the hip joint during use of the orthosis system by the user.

10. The orthosis system of claim 1, further comprising at least one spring coupled between the trunk brace and the frame, the at least one spring configured to remove at least a portion of the weight of the orthosis system from the user.

11. The orthosis system of claim 1, wherein a portion of the at least one hip joint may be rotated such that in a first position, orthosis system is adapted to be secured to a right leg of the user, and in a second position, orthosis system is adapted to be secured to a left leg of the user.

12. An orthosis system comprising:

a frame for supporting the orthosis system;

a trunk brace adapted to be secured to a trunk of a user;

at least one trunk joint coupling the trunk brace to the frame, at least one trunk joint enabling the trunk of the user to move relative to the frame in four degrees of freedom, wherein movement in each of the four degrees of freedom is uncoupled from movement in any of the other degrees of freedom;

an upper leg brace adapted to be secured to an upper leg of the user;

at least one hip joint coupling the upper leg brace to the trunk brace;

a lower leg brace adapted to be secured to a lower leg of the user;

at least one knee joint coupling the lower leg brace to the upper leg brace, the at least one knee joint including a knee actuator operable to rotate the lower leg brace relative to the upper leg brace; and a controller programmed to operate the knee actuator to rotate the lower leg brace relative to the upper leg brace.

13. The orthosis system of claim 12, wherein the controller is programmed to operate the knee actuator when a motion of the knee joint falls outside of a predetermined range.

14. The orthosis system of claim 13, wherein the controller operates the knee actuator to assist a walking motion of the user.

15. The orthosis system of claim 13, wherein the controller operates the knee actuator to resist a walking motion of the user.

16. The orthosis system of claim 12, wherein the knee actuator comprises a motor coupled directly to the knee joint to rotate the lower leg brace relative to the upper leg brace.

17. An orthosis method comprising steps of:

securing a user to an orthosis system having a trunk brace, an upper leg brace, and a lower leg brace;

coupling the trunk brace to a frame using at least one trunk joint, the at least one trunk joint enabling the trunk of the user to move relative to the frame in four degrees of freedom, wherein movement in each of the four degrees of freedom is uncoupled from movement in any of the other degrees of freedom;

enabling the user to walk while secured to the orthosis system; and actuating at least one of (i) a hip actuator to rotate the upper leg brace relative to the trunk brace and (ii) a knee actuator to rotate the lower leg brace relative to the upper leg brace.

18. The orthosis method of claim 17, wherein the actuating step comprises at least one of:

actuating the hip actuator when a motion of the hip joint falls outside of a predetermined range; and actuating the knee actuator when a motion of the knee joint falls outside of another predetermined range.

19. The orthosis method of claim 18, wherein the actuating step comprises:

actuating the at least one of the hip actuator and the knee actuator to assist a walking motion of the user.

20. The orthosis method of claim 18, wherein the actuating step comprises:

actuating the at least one of the hip actuator and the knee actuator to resist a walking motion of the user.

21. The orthosis method of claim 17, further comprising the step of:

recording a walking motion of the user while the user is secured to the orthosis system using one or more motion sensing devices.

* * * * *